United States Patent [19]

Jokinen et al.

[11] Patent Number: 4,756,801

[45] Date of Patent: Jul. 12, 1988

[54] PAPER-MAKING METHOD AND A COMBINATION OF INGREDIENTS TO BE USED IN IT

[75] Inventors: Olli J. Jokinen, Kirkkonummi; Lars Petander, Vaasa; Pirkko J. Virta, Muhos, all of Finland

[73] Assignee: Kemira Oy, Helsinki, Finland

[21] Appl. No.: 922,717

[22] Filed: Oct. 24, 1986

Related U.S. Application Data

[63] Continuation of Ser. No. 688,799, Jan. 4, 1986, abandoned.

[30] Foreign Application Priority Data

Jan. 11, 1984 [FI] Finland ..... 840093F

[51] Int. Cl.[4] ..... D21H 3/28; D21H 3/78

[52] U.S. Cl. ..... 162/175; 162/181.2; 162/181.3; 162/181.5

[58] Field of Search ..... 162/181.1, 181.2, 181.3, 162/181.5, 175; 106/214, 287.19, 299

[56] References Cited

U.S. PATENT DOCUMENTS

| | | | |
|---|---|---|---|
| 2,952,580 | 9/1960 | Frasch | 162/181.5 |
| 2,967,797 | 1/1961 | Weschler et al. | 162/181.5 |
| 3,043,740 | 7/1962 | Frasch | 162/181.5 |
| 3,629,055 | 12/1971 | Riem et al. | 162/181.2 |
| 4,362,781 | 12/1982 | Anderson | 162/181.2 |
| 4,388,150 | 6/1983 | Sunden et al. | 162/175 |

FOREIGN PATENT DOCUMENTS

| | | | |
|---|---|---|---|
| 609982 | 12/1960 | Canada | 162/181.5 |
| 50-35401 | 4/1975 | Japan | 162/181.2 |
| 796292 | 1/1981 | U.S.S.R. | 162/181.3 |

*Primary Examiner*—Peter Chin

*Attorney, Agent, or Firm*—Bucknam and Archer

[57] ABSTRACT

In a paper-making method cellulose is suspended in water and the obtained pulp suspension is dewatered in order to form a fiber web or a fiber sheet, water being removed from a pulp suspension which contains an organic polymer and an inorganic oligomeric Ti, Zr, Sn or B compound.

1 Claim, 6 Drawing Sheets

TOTAL RETENTION AS A FUNCTION OF THE RATE OF ROTATION

V
400 ml
300
200
100
0
0
10
20
30
40
50
60 %
● NULL EXPERIMENT
× CATIONIC STARCH
– CATIONIC STARCH+ SILICA SOL
o CATIONIC STARCH + TiOSO4

ASH RETENTION %
70
60
50
40
30
20
10
CAT. STARCH 1)% – 1 – – – 1 – –
SYNTH. POLYMER 1)% – – MAT.III 0,02 0,03 MAT.II 0,03 MAT.III 0,4 – MAT.III 0,4 MAT.III 0,4
TITANYL SULFATE 1)% – – – – – 0,5 0,2 0,5
1)% = PERCENT OF SOLID

PAPER-MAKING METHOD AND A COMBINATION OF INGREDIENTS TO BE USED IN IT

This is a continuation of application Ser. No. 688,799, filed Jan. 4, 1986 now abandoned.

BACKGROUND OF THE INVENTION

The present invention relates to a paper-making method in which pulp is suspended in water, and water is removed from the obtained pulp suspension in order to form a fiber web or a fiber sheet. The present invention relates in particular to a paper-making method in which water is removed from a pulp suspension which contains an organic polymer and an inorganic oligomer.

In addition, the present invention relates to an aqueous pulp suspension intended for use in the above-mentioned paper-making method or a bonding agent composition to be added to the circulating water of the paper-making process, containing an organic polymer and an inorganic oligomer or a compound which in an aqueous solution hydrolyses to an oligomer.

There are previously known paper-making methods in which water is removed from a pulp suspension which contains as the organic polymer a cationic or amphoteric guar gum or a cationic starch, and as the inorganic oligomer a colloidal silicic acid. In these prior known paper-making methods the ratio of the guar gum to the silicic acid, calculated as $SiO_2$, has been 0.01–25:1 and the ratio of the cation-active starch to the silicic acid has been 1–25:1.

The above-mentioned prior known bonding agent systems are, however, relatively expensive, and they are strongly dependent on the pH. It has been shown experimentally that their action decreases considerably when the pH drops below six. These prior known bonding agent systems also do not yield a good result when paper is made from pulps which contain groundwood.

The object of the present invention is therefore to provide a paper-making method and a bonding agent combination intended for use in the method, a combination by means of which it is possible to make paper having properties at least as good as those obtained by using the above-mentioned prior known bonding agent systems, and the action of which is not dependent on fluctuations of the pH in the process, or on whether the paper is made using neutral sizing or under acid conditions. A further object of the present invention is to provide a paper-making method and a bonding agent system intended for use in the method, by means of which it is possible to make paper from all kinds of pulp, such as groundwood pulp, bleached or unbleached cellulose, filler-free or filler-containing pulp, and by using the method and the bonding agent system according to the invention it is thus possible to make newsprint, SC-quality paper, fine paper, cardboard, liner, bag paper, etc.

The object of the present invention is, furthermore, to provide a bonding agent combination in which the inorganic oligomer, or the compound forming the oligomer, is a product having an economical price.

SUMMARY OF THE INVENTION

Thus, it has now been observed that, when the colloidal silica sol used in the above-mentioned prior known paper-making processes and bonding agent combinations is replaced with a titanium, zirconium, tin and/or borium compound, the pH-dependence of the retention decreases substantially and the action of the bonding agent system remains good within a very wide pH range of 4–8.

DESCRIPTION OF THE PREFERRED EMBODIMENTS

Figure 1:
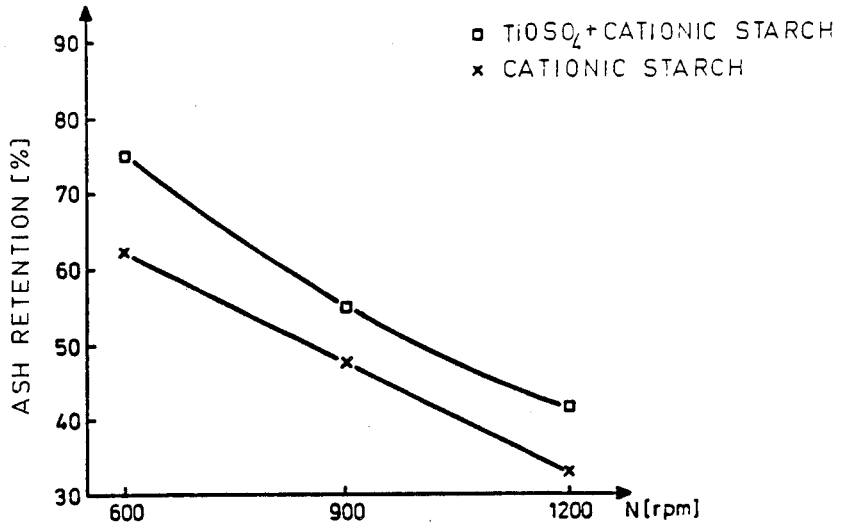

An organic polymer and an inorganic oligomer, or a compound which hydrolyses to an oligomer in an aqueous solution, are added to the pulp suspension either together or separately, and advantageously in such an amount that the pulp suspension contains the combination of the organic polymer and the inorganic oligomer at 0.1–15% of the dry weight of the pulp. The organic polymer used can be either a natural polymer, in which case the organic natural polymer and the inorganic oligomer advantageously amount to 0.4–2% of the dry weight of the pulp, or a synthetic polymer, in which case the organic synthetic polymer and the inorganic oligomer are present in the pulp suspension preferably at 0.1–1% of the dry weight of the pulp. The weight ratio of the organic natural polymer to the inorganic oligomer in the pulp suspension is preferably 0.2–20:1, and the weight ratio of the organic synthetic polymer to the inorganic oligomer is preferably 0.005–5:1.

In the method according to the present invention, the inorganic oligomer, or the compound which forms an oligomer in an aqueous solution, and the organic polymer can be added either together or separately, in which case any pulp constituent can, for example, be pretreated with one or both constituents, or the pulp can be treated as a whole.

The paper-making method according to the invention is also independent of the order in which the above-mentioned constituents are added, and of the point at which they are added. Thus, an organic polymer and an inorganic oligomer, or a compound which hydrolyses to an oligomer in an aqueous solution, can be added, for example, to the circulating water of the paper-making process in order to precipitate the solids present in it.

The inorganic constituent used can be an anionic, cationic or nonionic oligomer, or a titanium, zirconium, tin and/or borium compound which hydrolyses to an oligomer in water.

Of the usable titanium compounds there should be mentioned compounds which hydrolyse in water to orthotitanic acid or its oligomers, such as titanyl sulfate, titanium halide, titanium oxalate, and organic orthotitanic acid esters. The hydrolysis can take place either entirely after the batching, or it can be carried out completely or in part in advance, for example by allowing water to react under controlled conditions with the titanium compound. Titanyl sulfate is an especially advantageous titanium compound, and, calculated as $TiO_2$, it is preferably used at 0.1–1.4% of the dry weight of the pulp suspension.

It is also possible to use titanium compounds prepared in advance, such as acid oligomers and polymeric colloidal titanium sols or suspensions.

Of the usable zirconium compounds there should be mentioned anionic zirconium sulfate, zirconium chloride, ammoniumzirconium carbonate, and zirconium sulfate, cationic zirconium oxychloride and zirconium nitrate, and neutral zirconium acetate.

Of the usable tin compounds there should be mentioned $SnCl_4$, alkali or ammonium tin hydroxide, tin sulfate, $H_2SnCl_6.6H_2O$, etc.

Of the usable borium compounds there should be mentioned boric acid, polyborates and borates, and borium compounds which in water form boric acids or its salts. In addition to the above-mentioned titanium, zirconium, tin and/or borium compounds it is possible to use silicon compounds which hydrolyse in water to oligomers, such as $SiCl_4$ and $SiF_4$. Also phosphorus compounds which in water form an oligomer can be used in addition to the above-mentioned inorganic oligomers.

In the method and constituent combination according to the invention it is possible to use as the organic polymer any cationic, anionic and nonionic organic polymers and ampholytes conventionally used in paper making.

The cationic natural polymers used are preferably polysaccharides such as cationic starches or vegetable gum and its derivatives. Usable cationic synthetic polymers include polyacrylamides, polyethenimines, polyamines and polyamidamines. Their cationic groups are in general amino groups. Also melamine-formaldehyde polymers can be used.

Usable ampholytic organic polymers include all the above-mentioned polymers which, in addition to cationic groups, have anionic groups such as phosphate, sulfonate, carboxylate groups, etc.

Usable anionic organic polymers include such anionic polysaccharides as native starches, anionic guar gums, anionic cellulose derivatives such as CMC, anionic dextrans and alginates.

Usable synthetic anionic polymers include anionic vinyl polymers such as anionic polyacrylamides in which the anionic nature has been produced by means of metacrylic acid, maleic acid, itaconic acid, vinyl sulfonic acid, styrene sulfonic acid or vinyl phosphonic acid. Usable nonionic organic polymers include nonionic polysaccharides such as starches, guar gums, hydroxy-alkylated celluloses and dextrans.

If the inorganic constituent is anionic, it works usually best together with a cationic, nonionic or amphoteric polymer, and if the inorganic constituent is cationic, it usually works best together with an anionic, nonionic or amphoteric organic polymer.

By means of the method and constituent combination according to the present invention, a better retention, both filler retention (=ash retention) and overall retention, better dewatering and good forming, and high strength, especially when a polysaccharide is used as one of the constituents, are obtained, as compared with former bonding agent systems.

The invention is described below in greater detail with reference to the accompanying examples and drawings.

EXAMPLES

EXAMPLE 1

Figure 1B:
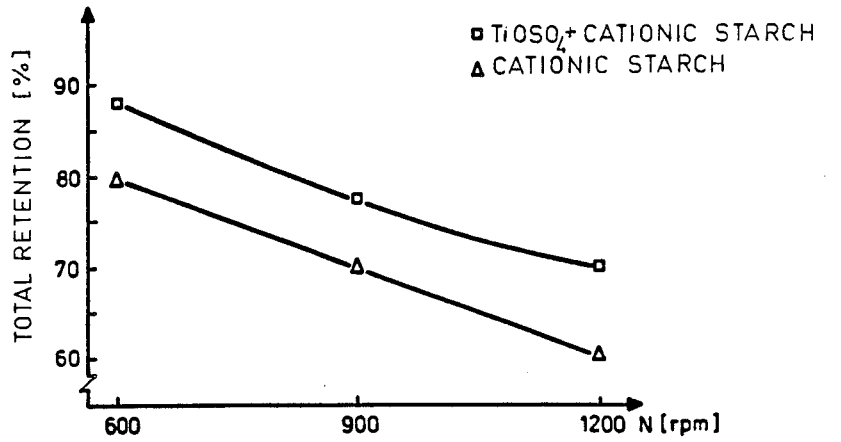

The strength of the floc formed by a cellulose (degree of grinding 20° SR) treated with one constituent combination according to the invention, titanyl sulfate ($TiOSO_4$) and a cationic starch, and a filler was evaluated in a dynamic dewatering vessel (Britt Dynamic Jar tester) by varying the rate of rotation of the mixer. The pulp used was pine cellulose, and the filler was kaolin (English China Clay). A compound which hydrolyses in an aqueous solution to an oligomer, i.e. titanyl sulfate, was mixed at about 2.7 percent by weight with a 10-percent (by weight) kaolin slurry half an hour prior to the carrying out of the test. Diluted pulp and kaolin slurry treated in the manner described above were poured into the Britt Jar, which was stirred at a rate of 1500 revolutions per minute. After this, the rate of rotation was adjusted to the desired value. The cationic starch which was used as the organic polymer was added at 10 seconds. The mixture was stirred for another 10 seconds, and the removal of water was started. In all tests, the pH was adjusted to 7, the solids content in the slurry was 0.5%, and the weight ratio of cellulose and kaolin was 50:50. The cationic starch was used at 1% by weight, and titanyl sulfate, calculated as $TiO_2$, was added at 0.4% of the solids content of the slurry. The control substance was the same cationic starch by itself. The results are shown in FIGS. 1*a* and 1*b*, which depict the ash retention (1*a*) and total retention of the pulp suspension treated with titanyl sulfate and cationic starch and of the pulp suspension treated with only a cationic starch, in percent, as a function of the rate of rotation.

EXAMPLE 2

This example compares the pH-dependence of the retention action of titanyl sulfate and silica sol when they were used together with a cationic starch. The pulp used was pine cellulose (degree of grinding 20° SR) and the filler was kaolin.

Titanyl sulfate, and respectively silica sol, was mixed as a solution of about 1.5percent (by weight) with a 10-percent (by weight) kaolin slurry half an hour before the test was started. The pH of the slurry thus obtained and of the cellulose slurry was adjusted to the desired value. The pH was adjusted by using sodium hydroxide or sulfuric acid.

The diluted pulp and the kaolin slurry treated in the above manner were poured into a Britt Jar, which was stirred at a rate of 1500 revolutions per minute. The rate of rotation was thereafter adjusted to 900 revolutions per minute. At 10 seconds the cationic starch was added, the stirring was continued for another 10 seconds, and removal of water was started.

The solids content of the slurry to be tested was at all measuring points 0.5percent by weight, and the weight ratio of cellulose and kaolin was 50:50. The cationic starch was used at 1% by weight, titanium sulfate, calculated as $TiO_2$, was used at 0.4% by weight, and silica sol, calculated as $SiO_2$, was used at 0.3% by weight of the solids content of the slurry. Thus, the titanyl sulfate and the silica sol were used in equal molar proportions.

Figure 2:
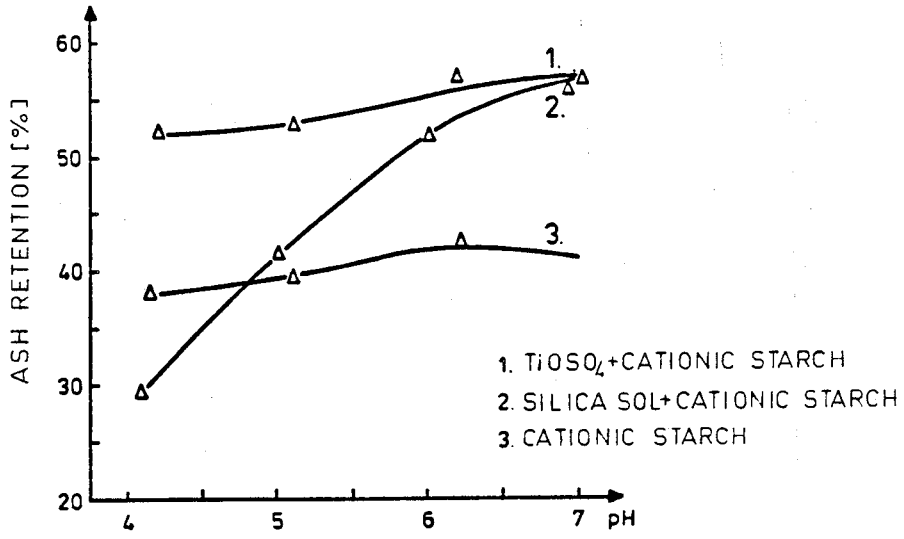
Figure 2B:
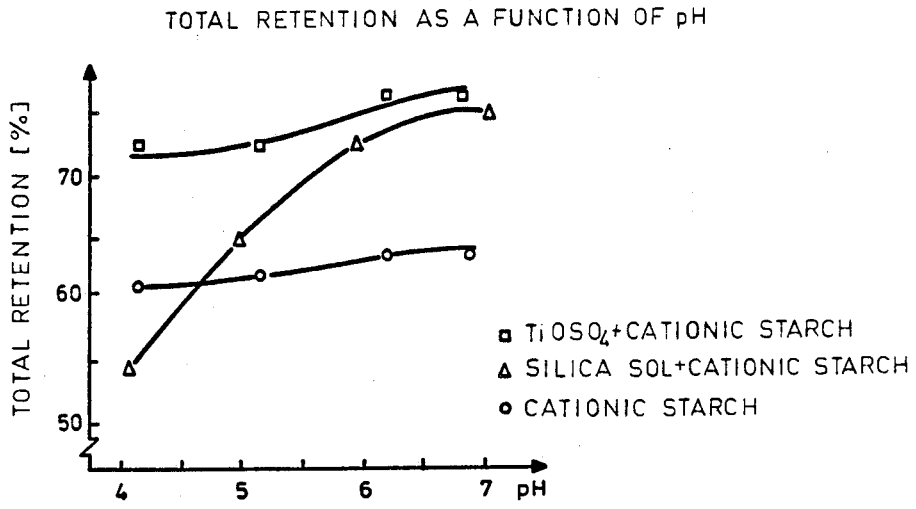

The results are shown in FIGS. 2*a* and 2*b*, which depict the ash retention (2*a*) and total retention (2*b*), in percent as a function of the pH, of a pulp suspension treated with titanyl sulfate and a cationic starch, a pulp suspension treated with silica sol and a cationic starch, and a pulp suspension treated with only cationic starch. It can be seen from FIGS. 2*a* and 2*b* that, when titanyl sulfate was used, the improvement of the retention between pH-values of 4 and 7 was almost independent of the pH. The retention of a bonding agent system containing silica sol and a cationic starch, known per se, was strongly dependent on the pH.

EXAMPLE 3

This example illustrates the effect of the adding method on the ash retention of titanyl sulfate and silica sol, as a function of the pH. Method A corresponds to the method presented in Examples 1 and 2. In method B, kaolin, cellulose and a cationic starch were mixed with each other half an hour before the test was carried out. The slurry thus obtained was poured into a tester in which the rate of rotation was 1500 revolutions per minute. Thereafter the rate of rotation was adjusted to 900 revolutions per minute. The mixture was stirred for 10 seconds and the pH was adjusted to the desired value by using sodium hydroxide or sulfuric acid. The titanyl sulfate, and respectively the silica sol, was also added at the same time. After a further stirring of 10 minutes the removal of water was started. The amounts of the constituents used were the same as in Example 2.

Figure 3:
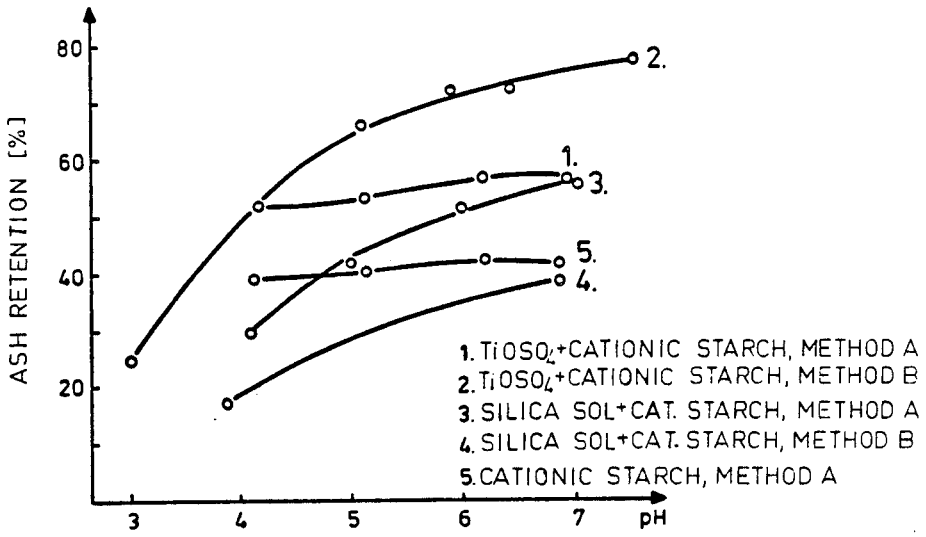

The results are shown in FIG. 3. FIG. 3 shows that method B is better when titanyl sulfate is used. Method A, on the other hand, is better suited for silica sol. With both method A and method B, a better filler retention is obtained by using titanyl sulfate than by using silica sol.

EXAMPLE 4

The purpose of this example is to describe the effect of the amount of titanyl sulfate on the filler retention. The tests were carried out in the same manner as in Example 3 (methods A and B) at a pH of 6–7. The amount of titanium sulfate, calculated as $TiO_2$, was varied between 0.1 and 1.4% of the solids content of the slurry being tested.

Figure 4:
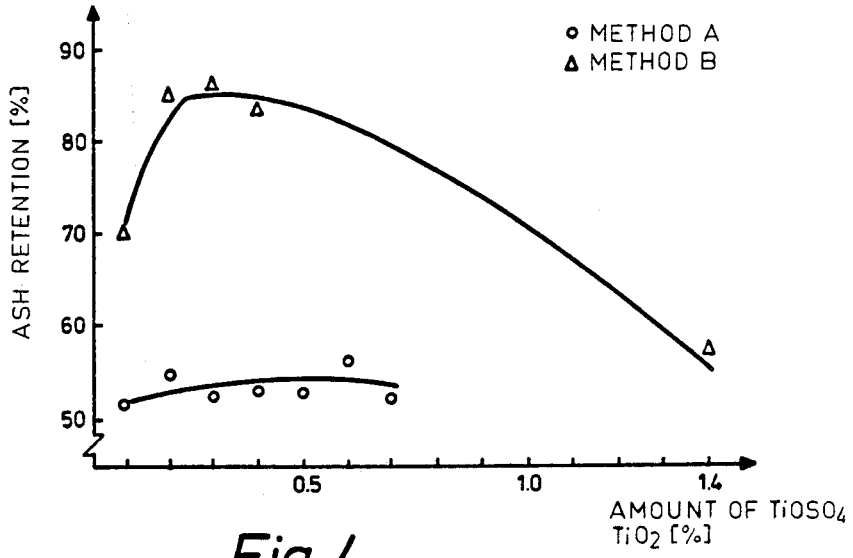

The results are shown in FIG. 4, which depicts the effect of the titanyl sulfate amount and the adding method on the ash retention. It can be seen that by using adding method A the filler retention does not change significantly when the $TiO_2$ content is 0.1–0.7% by weight of the solids. In adding method B, the optimum batch, calculated as $TiO_2$, is 0.2–0.4% by weight of the solids. When large amounts are used, retention clearly deteriorates.

EXAMPLE 5

This example describes the synergistic effects of various inorganic compounds which hydrolyse in water to oligomers, and combinations of the same, on the ash retention, when they were used together with a cationic starch. The experiments were carried out in the manner of Example 2, at a pH of 6–7, in such a way that part of the titanyl sulfate was replaced by silica sol or zirconium chloride, tin chloride or boric acid. For comparison, the action of each of the above-mentioned compounds separately together with a cationic starch was tested.

Figure 5:
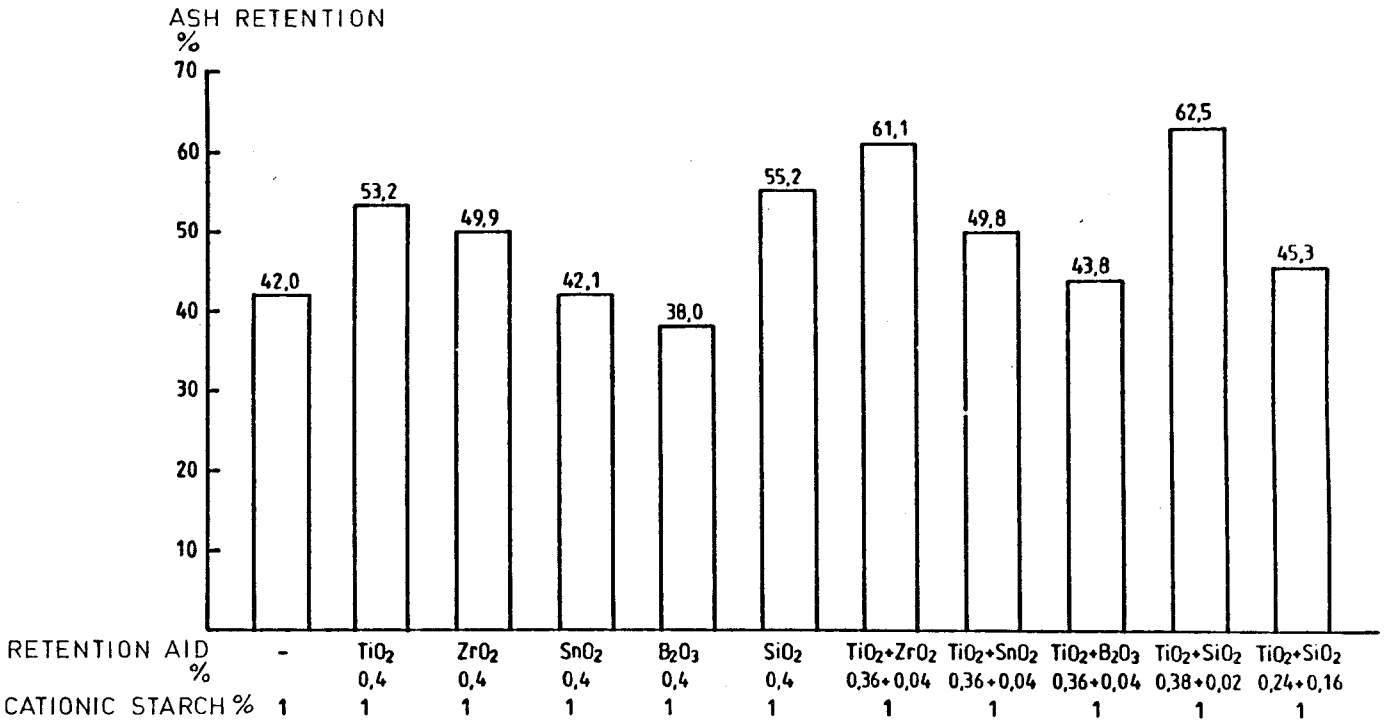

The results are shown in FIG. 5, which depicts the ash retention of the different compounds and compound combinations in percent. The results show that silica sol, zirconium chloride and titanyl sulfate are good retention aids even alone together with a cationic starch, but used together at suitable ratios they have a synergistic action. Tin chloride and boric acid do not, when used alone with a cationic starch, serve as retention aids, but when they are used together with titanyl sulfate the ash retention improves.

EXAMPLE 6

This example describes the effect of titanyl sulfate and silica sol on the rate of dewatering when they were used together with starch. A 50 μm screen was attached to the lower part of a plastic graduated glass having a volume of 500 ml and a diameter of 70 mm. 500 ml of a slurry containing 0.25% by weight kaolin, 0.25% by weight pine-birch cellulose, and a cationic starch 1% by weight of the solids content of the slurry was poured into the tester. The pH of the slurry had been adjusted to 6. Titanyl sulfate or silica sol was added at 0.3% of the solids, the contents were mixed by turning the graduated glass upside down five times within 15 seconds. The bottom bung was opened and the quantity of water which flowed out was measured as a function of the time.

Figure 6:
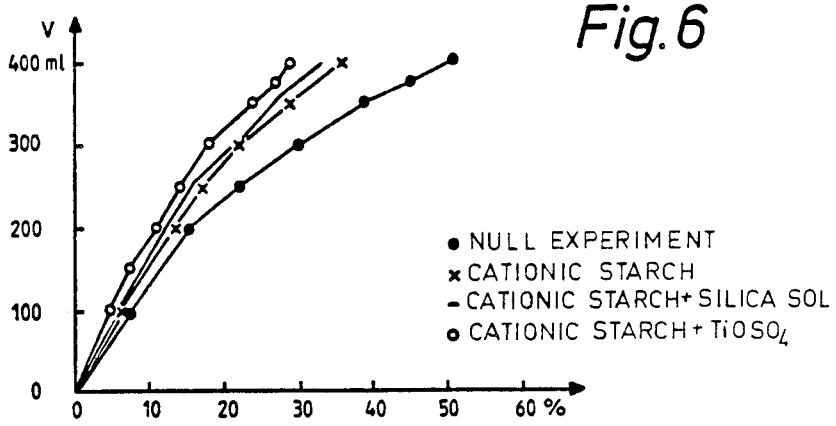

The results are shown in FIG. 6, and they show that titanyl sulfate improves dewatering better than does silica sol.

EXAMPLE 7

Sheets were prepared in a laboratory sheet mold by batching bleached pine sulfate (degree of grinding 20° SR) 1.7 g and filler kaolin 1.7 g per one sheet, except that at testing points 2 and 3 the batching of kaolin was 3.4 g per sheet and 5.1 g per sheet. Both batching method A and method B (cf. Example 3) were tested in the batching of the additives. The pH of the pulp suspension at the sheet-making stage was 7–8. At all testing points, with the exception of testing points 1–3, the amount of cationic starch was 1.0%, calculated on the basis of the dry weight of the pulp and the filler. The results are shown in Table 1 below.

TABLE 1

| Test No. | Batching method | Additive Name | Additive Amount % | Mass per area g/m² | Ash % | Tensile index Nm/g | Bonding strength g/m² | Symbol (in FIGS. 7,8) |
|---|---|---|---|---|---|---|---|---|
| [1]1 | — | — | — | 84 | 9.2 | 32.4 | 114 | X |
| [2]2 | — | — | — | 91 | 15.9 | 25.5 | 91 | X |
| [3]3 | — | — | — | 97 | 22.2 | 19.0 | 64 | X |
| 4 | B | — | — | 117 | 30.7 | 16.1 | 94 | O |
| 5 | B | silica sol | 0.3 | 117 | 29.2 | 16.8 | 122 | |
| 6 | B | $TiOSO_4$ | 0.3 | 124 | 32.5 | 13.4 | 91 | |
| 7 | B | $TiOSO_4$ | 0.4 | 121 | 32.5 | 14.7 | 98 | |
| 8 | A | — | — | 125 | 30.8 | 10.7 | 85 | |
| 9 | A | silica sol | 0.3 | 136 | 33.3 | 7.5 | 87 | |
| 10 | A | $TiOSO_4$ | 0.3 | 125 | 37.5 | 7.1 | 75 | |
| 11 | A | $TiOSO_4$ | 0.4 | 130 | 35.6 | 8.3 | 75 | |

[1]no starch
[2]no starch, kaolin 3.4 g/sheet
[3]no starch, kaolin 5.1 g/sheet

EXAMPLE 8

This example compares the working of the method according to the invention and the methods commonly used at present on a groundwood-containing pulp which contained 60% fiber (groundwood:cellulose=80:20) and 40% kaolin. The tests were carried out in the manner described in Example 2, at a pH of 5.5. Both a natural polymer (cationic starch) and synthetic polymers (mildly cationic polyacrylamide, i.e.

Figure 7:
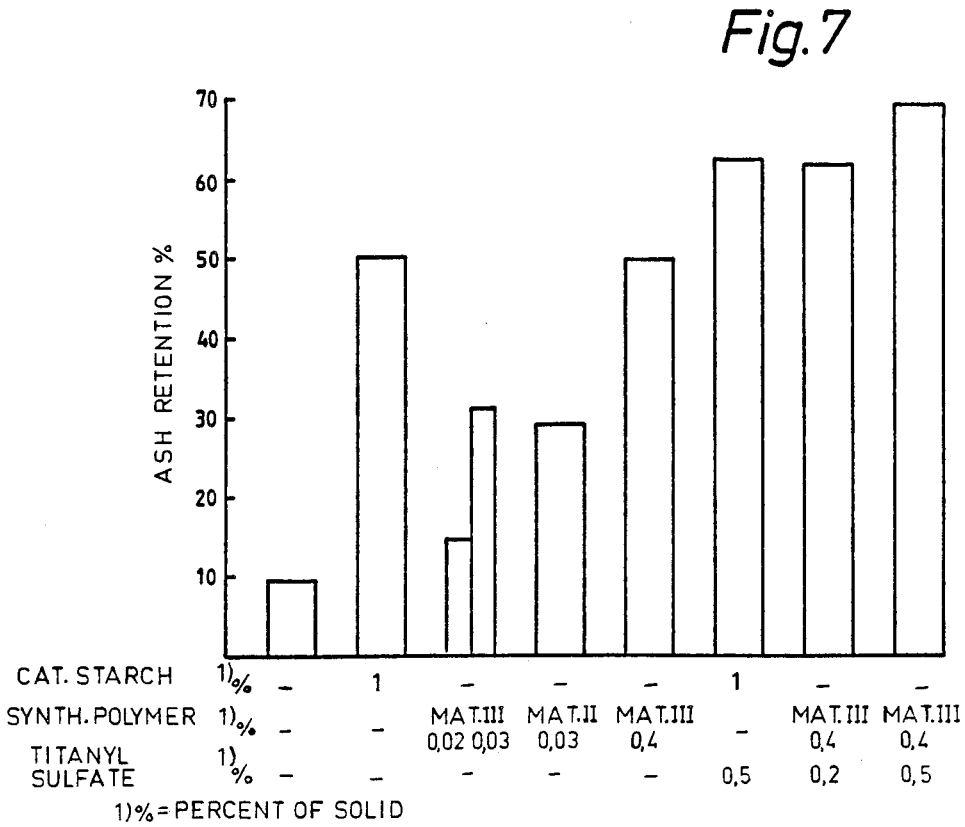

PAM (Agent I), cationic PAM (Agent II) and strongly cationic, short-chain PAM (Agent III)) were used as the organic polymer. The inorganic oligomer used was titanyl sulfate. The results are shown in FIG. 7, which depicts in percent the ash retentions of the different agents and constituent combinations. The results show that, as compared with the methods currently in use (synthetic polymers, Agents I and II), a clearly better ash retention is obtained by using the method according to the invention (cationic starch+$TiOSO_4$, or a synthetic polymer, Agent III+$TiOSO_4$).

EXAMPLE 9

The working of the combinations of constituents according to the invention was investigated by using the pulp composition of another SC-paper mill:

12% bleached cellulose
48% thermomechanical pulp
40% talcum

The ash retention was measured in accordance with Example 3, by using batching method B. The short-chain polyacrylamides (PAM) were batched in the same way as the cationic starch. The measured pH was 5.5, and the control was a mildly cationic polyacrylamide (PAM) generally used as a retention aid in the making of SC-paper. The results are shown in Table 2, which also shows the combinations of constituents and the amounts of constituents used, indicated in % by weight of the solids content of the slurry.

TABLE 2

| Combination of constituents | Ash retention, % |
|---|---|
| — | 10–13 |
| Mildly cationic PAM 0.02% | 30–33 |
| Cationic starch 1.0% | 20 |
| Cationic starch 1.0% + $TiOSO_4$ 0.15% | 81 |
| Cationic starch 1.0% + $TiOSO_4$ 0.3% | 90 |
| Cationic short-chain PAM 0.4% | 17 |
| Cationic short-chain PAM 0.4% + $TiOSO_4$ 0.15% | 36 |
| Cationic short-chain PAM 0.4% $TiOSO_4$ 0.3% | 54 |
| Strongly cationic, short-chain PAM 0.4% | 30 |
| Strongly cationic, short-chain PAM 0.4% + $TiOSO_4$ 0.15% | 54 |
| Strongly cationic, short-chain PAM 0.4% $TiOSO_4$ 0.3% | 57 |
| Anionic, short-chain PAM 0.4% | 14 |
| Anionic, short-chain PAM 0.4% + $TiOSO_4$ 0.3% | 23 |

It can be observed that by using the combinations of constituents according to the invention, a considerably better ash retention is achieved than by using the mildly cationic PAM currently used in the making of SC-paper. Anionic short-chain PAM does not work as well with $TiOSO_4$ as does cationic starch or cationic short-chain PAM. However, $TiOSO_4$ yields a better ash retention than does anionic short-chain PAM alone.

Figure 8:
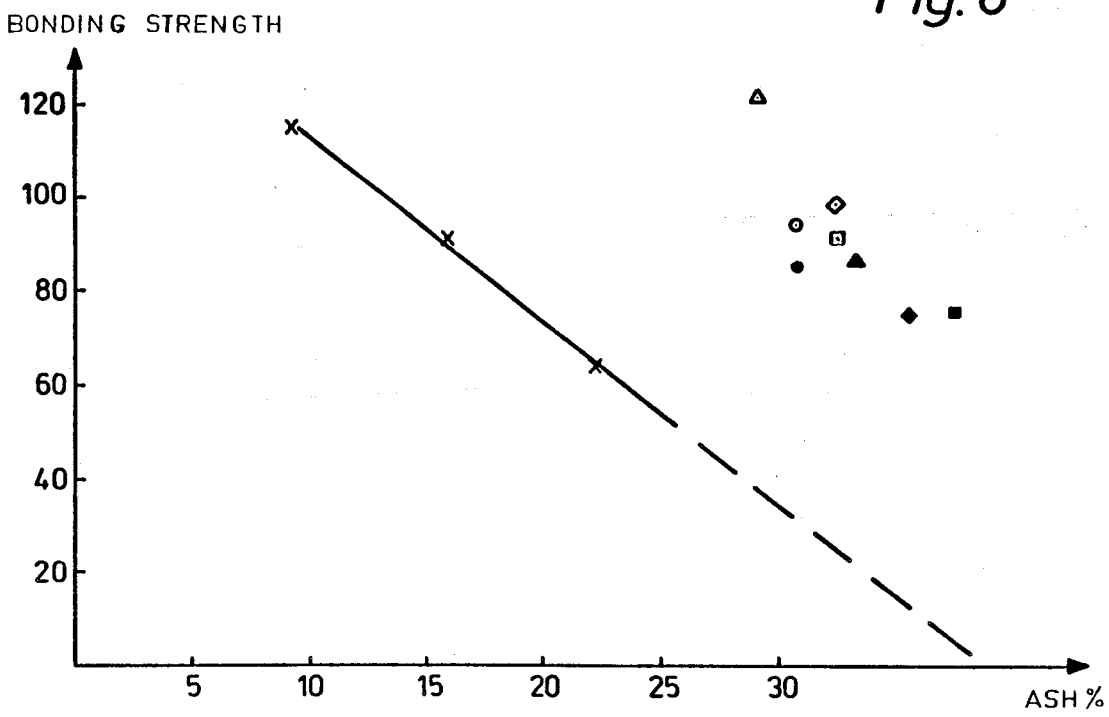

The examination of the results is complicated by the variation of the ash content from one testing point to another. For this reason both the tensile index and the bonding strength are shown in FIGS. 7 and 8, each as a function of the ash content.

The results show that also by using a laboratory sheet mold a better ash retention is obtained by using a cationic starch and titanyl sulfate, i.e. a higher content of ash by using a certain filler batching, than by using a cationic starch and silica sol. As regards strengths, the systems work in the same manner, and the difference as compared with only starch is slight. Under dynamic conditions starch alone does not, however, work properly as a retention aid, as shown by Examples 1–3. However, each bonding agent system yields a clear improvement over the situation in which no starch at all is used.

What is claimed is:

1. In the method of making paper from a suspension of cellulose pulp and a filler in water, wherein water is removed from said pulp suspension and a web or a sheet is formed, the improvement which consists of increasing the filler retention and overall retention by removing water from said pulp suspension in the presence of a retention aid which consists of a cationic starch and an inorganic oligomeric $Ti^{+4}$ compound from titanyl sulfate in the amount of 0.1–15% calculated on the basis of the dry weight of the pulp, at a pH of 4–8 wherein said cationic starch and said inorganic oligomeric $Ti^{+4}$ compound are present in a weight ratio of 0.2–20:1.

* * * * *